US006148995A

United States Patent [19]

De Laforcade

[11] Patent Number: 6,148,995

[45] Date of Patent: Nov. 21, 2000

[54] DEVICE AND METHOD FOR COMBINING AT LEAST TWO PRODUCTS

[75] Inventor: Vincent De Laforcade, Rambouillet, France

[73] Assignee: L'Oréal S.A., Paris, France

[21] Appl. No.: 09/198,594

[22] Filed: Nov. 24, 1998

[30] Foreign Application Priority Data

Nov. 24, 1997 [FR] France ..... 97 14723

[51] Int. Cl.[7] ..... B65D 81/32

[52] U.S. Cl. ..... 206/219; 215/DIG. 8; 220/529

[58] Field of Search ..... 206/219–221, 206/568; 215/DIG. 8; 220/529

[56] References Cited

U.S. PATENT DOCUMENTS

| | | | |
|---|---|---|---|
| 2,781,141 | 2/1957 | Lucien | 206/221 |
| 3,255,926 | 6/1966 | Modderno | 206/221 |
| 3,696,919 | 10/1972 | Miles . | |
| 3,856,138 | 12/1974 | Maekawa et al. . | |
| 4,483,439 | 11/1984 | Steigerwald et al. . | |
| 4,944,419 | 7/1990 | Chandler | 220/529 |
| 5,426,929 | 6/1995 | Mifune et al. | 206/220 |

FOREIGN PATENT DOCUMENTS

| | | |
|---|---|---|
| 0 060 401 | 9/1982 | European Pat. Off. . |
| 3 411 194 | 10/1985 | Germany . |
| 5-42175 | 8/1993 | Japan . |
| 9-202331 | 5/1997 | Japan . |
| 356 405 | 9/1961 | Switzerland . |

OTHER PUBLICATIONS

English Language Derwent Abstract of DE 3 411 194.

Patent Abstracts of Japan, vol. 097, No. 012, Dec. 25, 1997 (JP 09 202331).

*Primary Examiner*—Jim Foster

*Attorney, Agent, or Firm*—Finnegan, Henderson, Farabow, Garrett & Dunner, L.L.P.

[57] ABSTRACT

The present invention is a device for combining at least two products. The device includes a container having at least one wall, the wall defining an interior of the container, and an opening for allowing access to the interior of the container. The device also includes a separating element movable with respect to the container from a first position to a second position. In the first position, at least a portion of the separating element is in the interior of the container and defines in the interior of the container a first region for a first product and a second region for a second product. In the second position, the separating element is at least substantially removed from the interior of the container so that the regions are placed in fluid communication with one another to permit mixing of the first and second products. In one aspect of the invention, the separating element moves from the first position to the second position without passing through the opening of the container. In another aspect of the invention, the container has a removable cover. Also disclosed is a method of combining at least two products.

50 Claims, 4 Drawing Sheets

DEVICE AND METHOD FOR COMBINING AT LEAST TWO PRODUCTS

Under the provisions of 35 U.S.C. §119, this application claims priority of French Patent Application No. 9714723, filed Nov. 24, 1997, the disclosure of which is hereby incorporated by reference.

The present invention relates to a device and method for combining at least two products. In particular, the present invention may be used for producing a hair composition, such as a composition for dyeing or permanent-waving of hair.

In the field of cosmetics, in particular the field of dyeing or permanent-waving of hair, use is made of compositions which are the result of an extemporaneous mixing of two products: a first product, such as an oxidizing agent, generally in liquid form, and a second product, such as a dye, the consistency of which may be liquid-to-pasty, or pulverulent. In the case of a permanent-wave, use is made of an active agent in liquid form, and of a thickener in the form of a powder or of a cream.

There have been proposed a number of mixing devices for liquid/liquid or liquid/powder pairs of products. These mixing devices generally include a lower container containing the first product, an upper container containing the second product, a dispensing nozzle on the upper container, and a removable closure means capable of isolating the first container from the second. Means such as a trocar or actuating rod are provided so that the closure can be expelled prior to use and mixing can take place. The mixture thus produced is then dispensed by exerting pressure on deformable walls of the upper container.

In another type of mixing device, the two containers are concentric. This device may include means to displace a cylindrical skirt isolating a first product contained in an annular region outside of the cylindrical skirt from a second product contained in a central region inside of the cylindrical skirt. The displacement of the cylindrical skirt permits the two products to be brought into contact so that mixing may be performed. Mixing devices of this type are described for example in U.S. Pat. No. 3,696,919, U.S. Pat. No. 3,856,138 and EP 0,060,401.

These devices are generally unsuitable for producing a mixture in which at least one of the components has high viscosity. In particular, the structure of these devices has significant drawbacks and disadvantages when used with a product of high viscosity. For example, it is difficult to produce a homogeneous mixture with such devices. Furthermore, a significant amount of the highly viscous product sometimes remains attached to walls of the device, and therefore does not become involved in the mixing. Therefore, the properties of the resulting mixture differ significantly from those anticipated.

Some mixing devices are also not suitable for dispensing a mixture of high viscosity. In some of these devices, pressure must be exerted on the walls of the device in order to dispense the final mixture. When there is a highly viscous mixture, this would require an enormous force. Furthermore, all of these devices are particularly unsuitable for packaging a small amount of a high-viscosity component. Finally, on account of their design, such devices prevent removal and application using an applicator brush or one's fingers.

Mixtures involving at least one high-viscosity product, such as a paste, are normally mixed in a bowl. In order to do this, the two components are separately packaged and stored, then introduced into the bowl, and then mixed using an appropriate tool. The mixture obtained is then removed using an applicator brush or one's fingers. This method requires a large number of operations in order to obtain a simple mixture. Furthermore, the cost of separately packaging each of the components is relatively high. The storage of the separate mixing bowl, first and second components and their respective packaging can take up significant space.

In light of the foregoing, there is a need in the art for an improved mixing device which will permit easy and compact storage and mixing of the components, as well as removal of the mixture from the device.

Accordingly, the present invention is preferably directed to a device for combining two products that substantially obviate one or more of the limitations of the related art.

One of the objects of the invention is to provide a device for the extemporaneous mixing of two products, at least one of which may be of high viscosity, and which is as simple and practical to use as the mixing devices traditionally used for mixing two liquid components.

Another object of the invention is to provide a mixing device which, for performing the mixing, has all the advantages of the automatic devices traditionally used for mixing two liquids and allows any method of removal and application traditionally used for high-viscosity mixtures, especially using a spatula, a brush, or fingers.

A further object of the invention is to provide a mixing device which is economical to produce and which takes up a small amount of space compared with the separate packaging of the various components of the mixture.

It should be understood that the invention could still be practiced without performing one or more of the preferred objects and/or advantages. Still other objects and/or advantages will become apparent after reading the following description of the invention.

To achieve these and other advantages and in accordance with the purpose of the invention, as embodied and broadly described herein, the invention includes a device for combining at least two products. The device includes a container having at least one wall, the wall defining an interior of the container and an opening for allowing access to the interior of the container; and a separating element. The separating element is movable with respect to the container from a first position to a second position. In the first position, at least a portion of the separating element is in the interior of the container and defines in the interior of the container a first region for a first product and a second region for a second product. In the second position, the separating element is at least substantially removed from the interior of the container so that the regions are placed in fluid communication with one another to permit mixing of the first and second products.

In one aspect of the invention, the separating element moves from the first position to the second position without passing through the opening of the container. This enables mixing to be more easily performed because the separating element does not block the opening. The cross-section of the opening is not affected by the presence of the separating element in its removed position. Therefore, the cross-section of the opening does not need to take into account of the shape or size of the separating element. Because the separating element is at least substantially removed from the interior of the container when it is moved to the second position, it is easy to mix the at least two products. Preferably, the separating element will not obstruct the process of mixing the products or the removal of the mixed products because the separating element is at least substantially removed from the interior of the container when it is in the second position. This is particularly helpful when one of the products is a high viscosity material.

In yet another aspect, the separating element is formed of at least one of a rigid and semi-rigid material. In a further aspect, the separating element is configured so that it lacks deformation as it moves from the first position to the second position.

The separating element divides the interior of the container into a plurality of regions, for example, a first and second region, when the separating element is in the first position. The first region contains the first product, and the second region contains the second product. It is understood that each of these regions could also contain a plurality of products. The products can be any of a variety of substances including, but not limited to, solids, powders, pastes, cremes, or solids. In the preferred embodiment, the separating element has a hollow interior which defines the second region when the separating element is in the first position. However, the separating element can be any structure, such as a wall, which divides the interior of the container into a plurality of regions. The container has an approximately constant volume V. The first region has a volume V1, and the second region has a volume V2. When the separating element is in the first position the volume V2 of the second region is approximately equal to V−V1.

In the preferred embodiment, the device further includes a guiding stem or piston which is axially fixed with respect to the wall of the container. The guiding stem is positioned in the hollow interior of the separating element when the separating element is moved from the first position to the second position. The guiding stem generally defines the bottom of the second region. Thus, unlike the conventional piston-cylinder systems in which a piston moves axially inside a cylinder, according to the invention, the guiding stem at the bottom of the second region forms a fixed piston inside a moving separating element which acts as a cylinder. The guiding stem or piston thus slides along the inner walls of the separating element, thereby retaining inside the container all of the product that was initially contained in the second region.

In a further aspect, the device includes a passage in the wall of the container. The separating element passes through the passage during movement of the separating element between the first position and the second position. The passage is sized to limit flow of the first and second products through the passage when the separating element moves from the first position to the second position. The guiding stem is surrounded by this passage passing through the thickness of the wall of the container. The size of the passage, in combination with any additional sealing structure, prevents leaks when the separating element passes through the passage to move from the first to the second position. This also prevents any product from remaining attached to the separating element. Depending on the particular embodiment, the movement may be, for example, a simple translational movement or a translational movement coupled with a rotational movement (i.e., a helical movement). In the preferred embodiment, the separating element and guiding stem each have a cylindrical shape. The passage in the wall is preferably an annular space defined between the guiding stem and the wall. The combination of the guide stem and the wall form the axially fixed bottom of the container.

After the movement of the separating element from the first position to the second position to remove the separating element at least substantially from the interior of the container, the interior of the container is completely unobstructed. This makes it possible to homogenize or complete the mixing more easily by using an appropriate tool. The total volume of the container is unchanged (to within the wall thickness of the separating element). The complete removal of the separating element from the interior of the container is advantageous. No dead volume is created in the interior of the container. In addition, there are no difficult regions to access. Thus, nothing in the interior of the container disturbs the operation of homogenizing the mixture. By the removal of the separating element, the two products forming the mixture are brought into contact automatically, as in liquid/liquid mixers, without requiring manual handling of the products in order to bring them into contact with each other. Preferably, the device comprises a small number of parts thereby reducing costs.

More specifically, the separating element may be a hollow cylinder placed inside the container and oriented axially in such a way as to delimit an annular volume containing the first product and a central volume containing the second product. The cylinder has a first end which is open and a second end which is closed in a sealed way by a fixed piston formed by a portion of the axially fixed bottom. The cylinder may pass by a leakproof sliding about the fixed piston from a first position where the cylinder isolates the first product from the second product, to a second position in which the cylinder lies approximately outside the interior of the container, on the opposite side of the axially fixed bottom from the opening.

Preferably, the fixed bottom comprises an annular part of the container as well as a central part made up of the fixed piston or guiding stem. The passage separates the annular part from the central part of the fixed bottom so as to allow the hollow cylinder to slide about the fixed piston. Means are provided for forming a seal between the hollow cylinder and a free edge of the annular part of the bottom. Such a seal can be obtained by screwing and/or by any other appropriate seal such as an elastomeric seal. The central part may consist of the transverse wall of a guiding stem or central pedestal situated on the side of the container remote from the opening. The guiding stem has an axial height approximately equal to the axial height of the cylinder.

In a further aspect, the device includes a removable cover for covering the opening. The separating element may have an end forming a seal with the cover when the separating element is in the first position. When the separating element is cylindrical, the cover may close the open end of the separating element in a sealed manner. Advantageously, the open end of the hollow cylinder lies approximately in the plane of the free edge delimiting the opening, the hollow cylinder being closed by a self-sealing skirt.

According to one embodiment of the present invention, the separating element has an outer surface including a helical screw thread. The helical screw thread engages the portion of the wall defining the passage, also referred to as the annular part of the fixed bottom, which has an inner edge. The separating element is rotatable with respect to the wall to cause movement of the separating element from the first position to the second. This screw structure provides a seal between the hollow cylinder and the annular part of the axially fixed bottom. In this embodiment, an actuating collar may be provided on the separating element and arranged around the guiding stem or central pedestal. Such a collar may have fins or other reliefs in order to make it easier to manipulate.

In this embodiment, the container may be mounted on at least two peripheral legs which are fixed with respect to the container and arranged around the annular collar. The legs extend from the wall of the container. The legs are spaced apart angularly in such a way as to permit access to the actuating collar, so that mixing can be performed. The legs may be arranged in a half-moon shape around the guiding stem or central pedestal and contribute to ensuring that the device is stable. Preferably, the guiding stem has a base coupled to the container by one of bonding, welding, clipping or fastening. Alternately, the base may be integral with the container.

According to another embodiment of the present invention, the outer surface of the guiding stem has a screw thread capable of interacting in a sealed way with a corresponding screw thread provided on the inner surface of the hollow cylinder. The guiding stem is rotatable with respect to the hollow cylinder to cause movement of the separating element from the first position to the second position. A rotatable actuator may be provided on the guiding stem for causing the separating element to pass from the first position to the second position. Such an arrangement has the advantage that it is possible to form an assembly which is completely enclosed under the bottom of the container.

In a further aspect of the invention, a rotation limiter is provided for limiting rotation of the separating element. Such immobilizing means may comprise at least one rib formed on the outer surface of the hollow cylinder and capable of engaging at least one corresponding notch made in the outer edge of the annular space. Any structure which limits the rotation of the separating element may be also used.

According to this embodiment, the container may be mounted on an annular leg surrounding the guiding stem with the annular leg extending from the wall of the container. The annular leg is fixed with respect to the container. Advantageously, the annular leg is molded with the container and made of a thermoplastic such as polypropylene or polyvinyl chloride. The guiding stem may have, at an end remote from the opening of the container, a base coupled to the annular leg, especially by snap-fastening, so as to be free to rotate with respect to the said annular leg.

In a preferred form, the wall of the container may be in the shape of a bowl with a wide opening. It should be understood, however, that the container may be any of a large variety of different shapes.

By way of example, the first and second products are intended for the preparation of a hair composition. In this context, the first product may be an oxidizing agent of liquid consistency, and the second product may be a dye of liquid to pasty or pulverulent consistency. According to an alternative, the hair composition is a two-component permanent-waving product, the first product is a permanent-waving active agent in liquid form, and the second product is a thickener, especially in the form of a powder. Preferably, the mixture is an extremely viscous paste which can be applied by hand or using a brush.

In a further aspect, the invention includes a method for combining at least two products in a device including a container having at least one wall defining an interior of the container and an opening for allowing access to the interior of the container, the device further including a removable cover for covering the opening, and a separating element moveable with respect to the container from a first position, in which at least a portion of the separating element is in the interior of the container and defines in the interior of the container a first region containing a first product and a second region containing a second product, to a second position in which the separating element is at least substantially removed from the interior of the container. The method includes moving the separating element from the first position to the second position to place the regions in fluid communication with one another and thereby permit mixing of the first and second products, the separating element moving from the first position to the second position without passing through the cover. The method also includes removing the cover to access the first and second products via the opening.

In a further aspect, the method includes agitating the container when the separating element is in the second position to mix the first and second products.

In yet a further aspect, the method includes stirring the first and second products after the separating element moves to the second position.

The moving of the separating element may further include passing the separating element through a passage in the wall, as well as rotating an actuator to move the separating element. The moving of the separating element may further include moving the separating element via a helical thread.

The above methods allow the separating element to be at least substantially removed from the interior of the container. By moving from the first position to the second position without passing through the cover, many of the advantages discussed earlier are obtained.

A further aspect of the invention includes a device for combining at least a first product and a second product. The device includes a container, a separating element and a piston. The container has at least one wall, the wall defining an interior of the container for containing the first and second products, and an opening for allowing access to the interior of the container. The separating element is in the interior of the container and has open end in fluid communication with a hollow interior of the separating element. The separating element is movable from a first position to a second position. In the first position, the first product is contained in a region between the separating element and the wall of the container and the second product is contained in the hollow interior of the separating element. The piston is in the hollow interior of the separating element and is axially fixed with respect to the container so that when the separating element moves relative to the piston from the first position to the second position, the piston forces the first product from the open end of the separating element to permit mixing of the first and second products in the interior of the container.

In another aspect of the device described above, the device includes a removable covering for covering the opening. Additionally, the open end of the separating element may form a seal with the cover when the separating element is in the first position. In a further aspect, the separating element is configured so that the separating element is at least substantially removed from the interior of the container when the separating element is in the second position. In a further aspect, the separating element and the piston each have a cylindrical shape.

Besides the structural arrangements and method set forth above, the invention could include a number of other arrangements and methods, such as those explained hereinafter. It is to be understood that both the foregoing general description and the following detailed description are exemplary, and are intended to provide further explanation of the invention as claimed.

The accompanying drawings are included to provide a further understanding of the invention and are incorporated in and constitute a part of this specification. The drawings illustrate embodiments of the invention and, together with the description, serve to explain the principles of the invention.

Figure 1A:
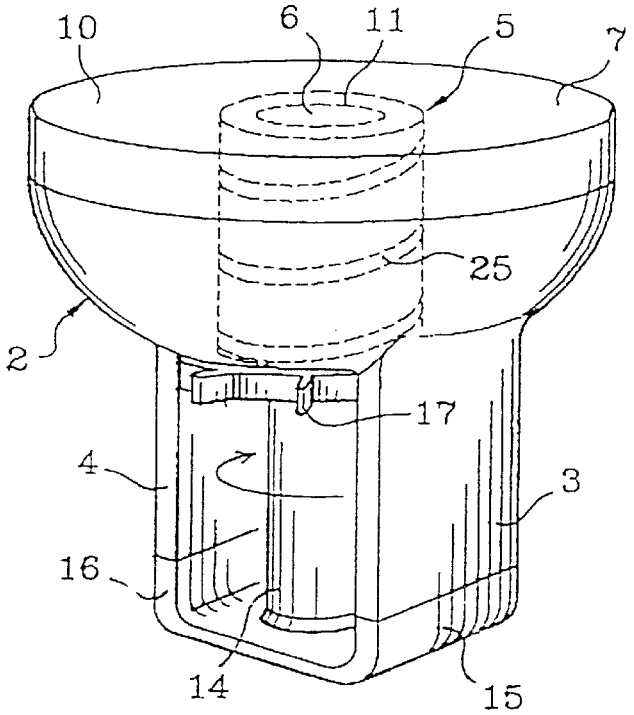
FIG. 1A is a perspective view of the device according to a first embodiment of the invention.

Reference will now be made in detail to the present preferred embodiments of the invention, examples of which are illustrated in the accompanying drawings. Wherever possible, the same reference numbers are used in the drawings and the description to refer to the same or like parts having similar structural configuration(s) and/or function(s).

Figure 1B:
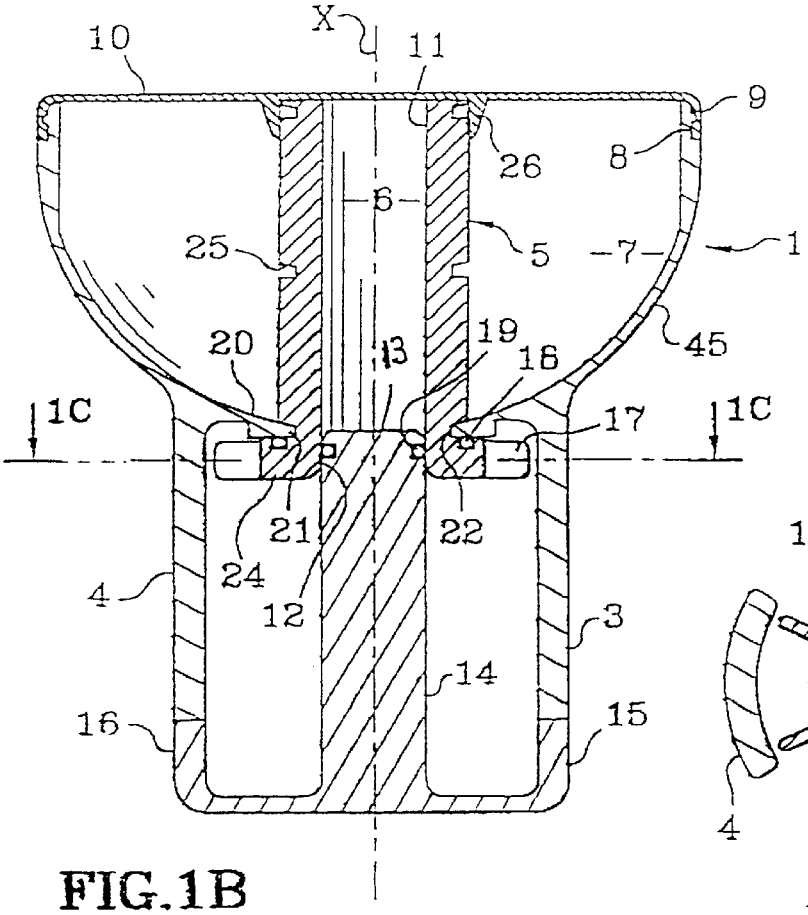
FIG. 1B is a cross-sectional side view of the device of the first embodiment.
Figure 1C:
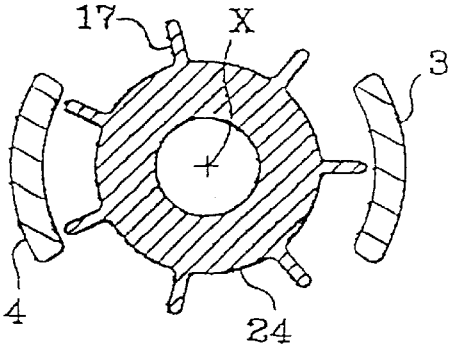
FIG. 1C is a cross-sectional view along line 1C—1C of FIG. 1B.

FIGS. 1A—1C to which reference is now made, illustrate a first embodiment of the mixing device according to the invention. The device 1 according to this embodiment is in the form of a container 2 with a wide opening 8, mounted on two legs 3, 4 obtained by moulding with the container 2. The container 2 includes at least one wall 45 in the shape of a bowl. Inside the container 2, along the axis X, there is a hollow cylindrical skirt 5 which, with the wall 45 of the bowl, delimits a first region 7 and a second region 6. (The hollow cylindrical skirt 5 is hereinafter referred to as the separating element.) In an initial position of the separating element 5, the first and second regions 7 and 6, are preferably isolated from one another, the first region 7 is annular, and the second region 6 is a central, cylindrical shaped region. The first annular region 7 has an initial volume V1 containing a first product, which may include, for example, an oxidizing agent in liquid form. The second central region 6 has initial volume V2 containing a second product, which may include, for example, a dye in the form of a cream or of a powder. The overall volume of the container, namely approximately V1+V2 (plus the wall thickness of the separating element 5) is V. The separating element 5 has an open end 11 which, in the position illustrated in FIGS. 1A and 1B, that is to say prior to mixing, is approximately in the plane of the opening 8 delimited by the free edge 9 of the container 2. A screw-on covering or lid 10 covers the opening 8. The lid 10 is removable and closes the opening delimited by the open end 11. A sealing skirt 26 formed by the lid 10 allows the annular region 7 to be isolated in a leaktight way from the central region 6.

The separating element 5 has an end 12 which is opposite the open end 11. The end 12 is closed in a sealed way by a bottom consisting of an end wall 13 of a central pedestal or guiding stem 14 placed under the wall 45 of the container 2. A seal 19 may be provided on the guiding stem 14 in the vicinity of the end wall 13 so as to provide sealing closure of the end 12. The guiding stem 14 has a height approximately identical to the height of the separating element 5 and terminates at a base including two portions 15, 16 connected to the legs 3, 4 by bonding, fastening, clipping, welding or any other appropriate technique, so as to prevent the guiding stem 14 from rotating. This then forms an assembly capable of resting in a stable manner on a flat surface. The end 12 of the separating element 5 lies outside the interior of the container 2 (under the interior of container 2) and terminates in a part 24. The part 24 extends outwards 90° from the axis X and includes radially-projecting elements forming an actuating collar 17. A space between the legs 3, 4 allows the user to access the actuating collar 17 so that mixing can be performed, as is described in detail later.

As shown in FIG. 1B, the bottom of the wall 45 has an annular part 20. A free edge 21 of the annular part 20 is situated to delimit, with the end wall 13 of the guiding stem 14, an annular space or passage 22 capable of receiving the separating element 5. A seal 18 may be provided between the annular part 20 and the part 24, so as to improve sealing in the storage position shown in FIGS. 1A and 1B. The outer surface of the separating element 5 has a helical screw thread 25 capable of interacting with the free edge 21, so that when the collar 17 is turned, the rotational movement of the separating element 5 is accompanied by a movement of the separating element 5 axially until its open end 11 is approximately level with the free edge 21. In this position, the central region 6 is placed in communication with the second region 7. The volume V (interior) of the container 1 is preferably free of any projecting part or relief liable to create dead volumes which might be prejudicial to the homogenizing of the mixture and/or the removal thereof.

As shown in the sectional view illustrated in FIG. 1C, the legs 3 and 4 are half-moon shaped. This shape permits access to the actuating collar 17.

Figure 2C:
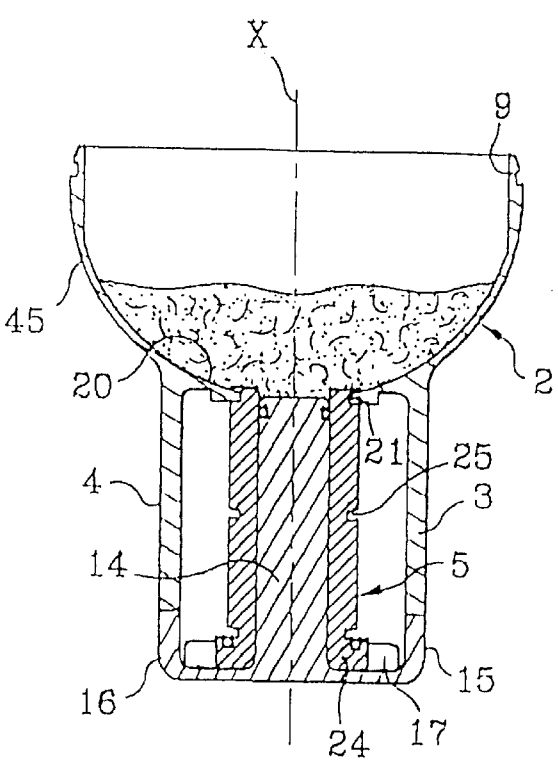
FIG. 2C illustrates the device of the first embodiment after the components have been mixed and the cover removed.
Figure 2B:
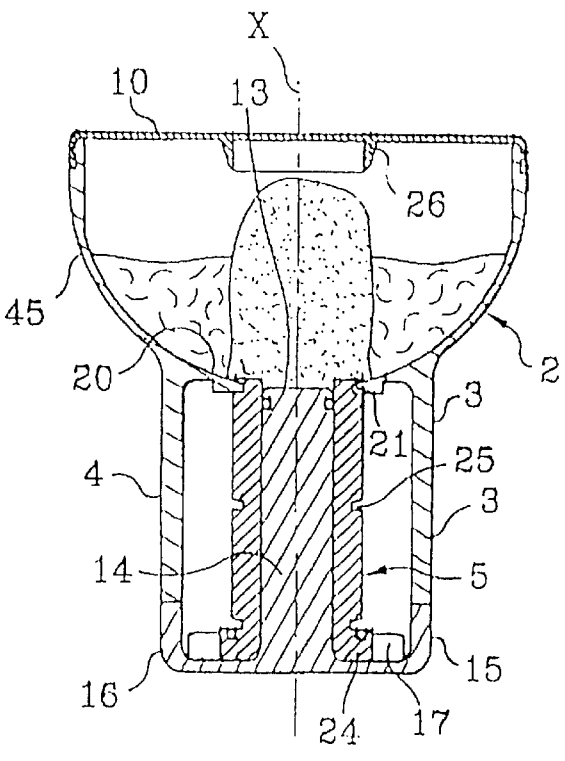
FIG. 2B illustrates the device of the first embodiment after the separating element has been lowered.
Figure 2A:
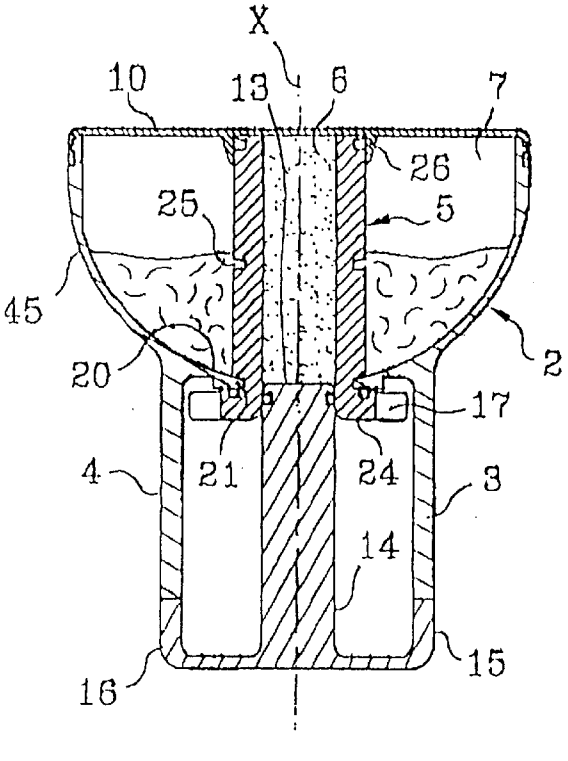
FIG. 2A illustrates the device of the first embodiment in its initial position prior to lowering of the separating element.

FIGS. 2A–2C illustrate the operation of the mixer according to the invention. In FIG. 2A, the separating elements is in its first position where the products are isolated from one another. The dye in the form of a cream is contained in the central region 6 of volume V2. The oxidizing agent is in the annular region 7 of volume V1. As shown in FIG. 2A, the two products are isolated from one another. Preferably the container 2 is covered with the screw-on lid 10.

To perform mixing, a user rotates the collar 17 so as to cause axial movement of the separating element 5 away from the opening 8 of the container 2. The end wall 13 of the guiding stem 14 acts as a fixed piston, and maintains the dye in the interior container 2 as the separating element 5 descends. Furthermore, the fixed piston 15 forces all of the dye in the separation element 5 from the open end 11. The volume of dye in the separating element 5 decreases gradually until it is approximately equal to zero in the position illustrated in FIG. 2B. This corresponds to the second position of the separating element 5. In this position, the separating element 5 is preferably fully situated outside the interior of the container 2 to permit the interior to have a substantially smooth surface free of any relief or any depressions liable to impede the homogenizing of the mixture and/or the removal thereof. The overall volume of the container 2 after mixing is identical to its initial volume. It is to be understood that there may be designs where the separating element 5 is not completely removed from the interior of the container 2 when it is placed in the second position. However, because the separating element 5 is substantially removed, the above advantages will be obtained.

In FIG. 2C, the lid 10 shown in FIG. 2B has been removed. The mixture can be homogenized using a spatula, for example, and removed and applied in the conventional way using a brush, or using fingers, it being possible for the free edge 9 of the container 2 to be used for wringing out the brush. Alternatively, the device may be agitated while the lid 10 is on the container 2 in order to permit thorough mixing of the first and second products.

Figure 3A:
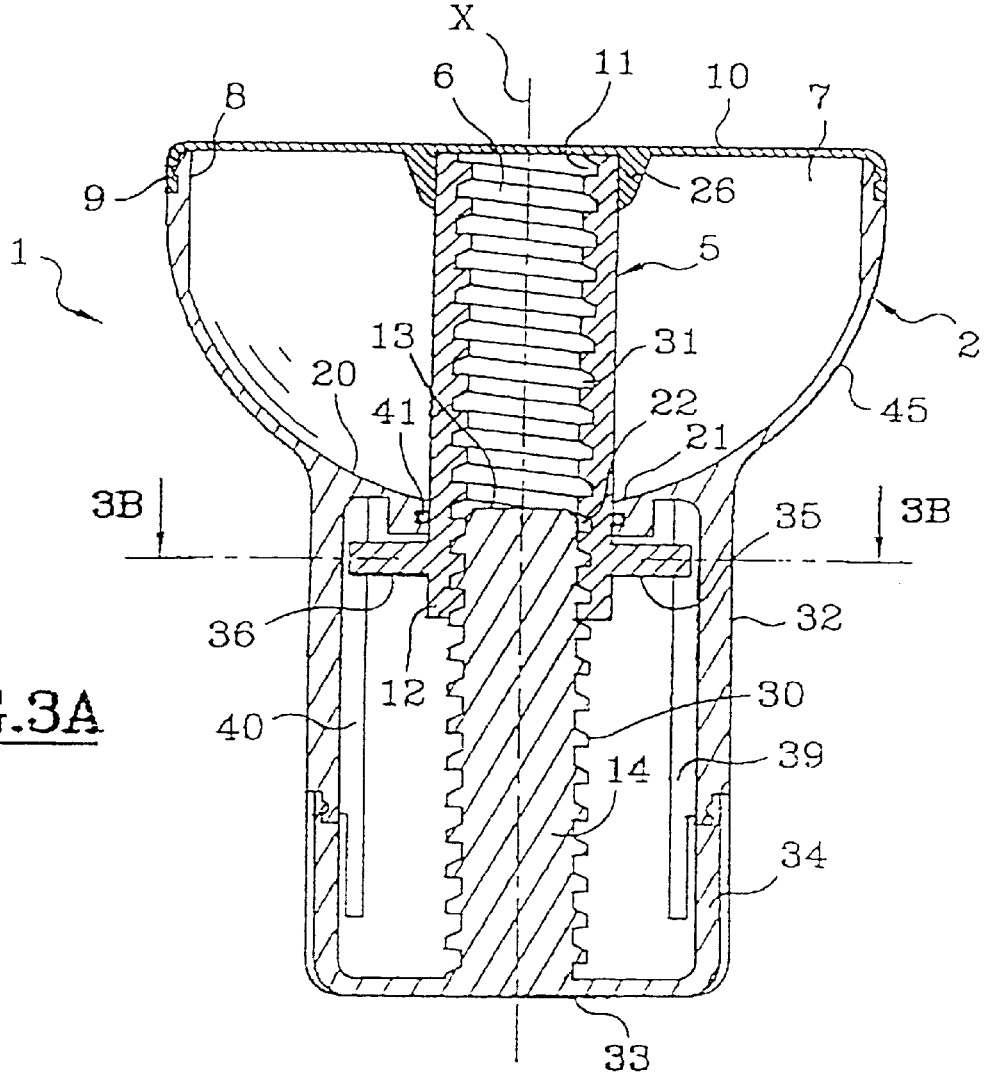
FIG. 3A is a sectional side view of the device according to a second embodiment, prior to a lowering of the separating element.
Figure 3B:
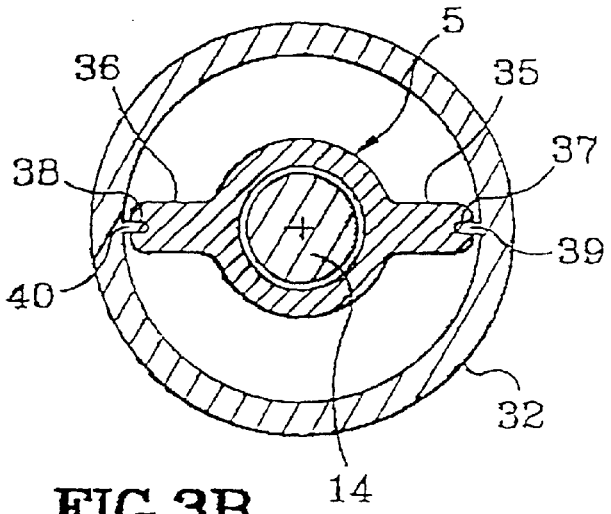
FIG. 3B is a cross-sectional view along line 3B—3B of FIG. 3A.
Figure 3C:
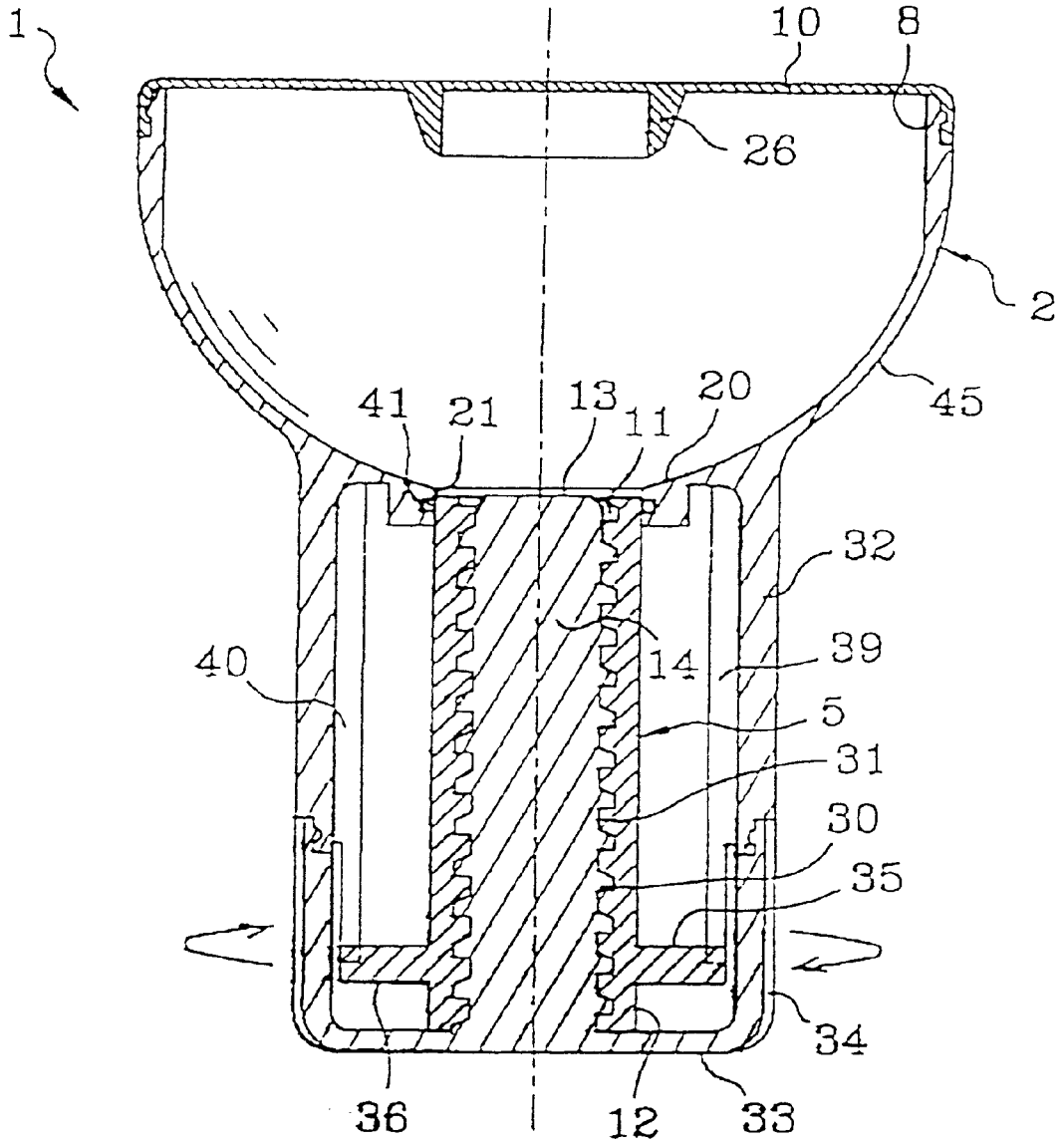
FIG. 3C is a sectional side view of the device according to the second embodiment, after lowering of the separating element.

FIGS. 3A–3C illustrate a second embodiment of the present invention. The embodiment in FIGS. 3A–3C is, in terms of its shape, slightly different from the embodiment just discussed with reference to FIGS. 1A–1C and 2A–2C. In this embodiment, the guiding stem 14 bears, on its outer surface, a screw thread 30 capable of interacting with a corresponding screw thread 31 provided on the inner surface of the separating element 5. The screwed connection ensures that the closure at the end 12 of the separating element 5 is a sealed closure.

In this embodiment, the container 2 is mounted on an annular leg 32. The annular leg 32 extends from the wall 45 of the container 2. A separating element or guiding stem 14 is axially fixed, however it is free to rotate with respect to the annular leg 32. The guiding stem 14 has, at its end opposite to an end wall 13, a base which includes a transverse wall 33 having a rim 34 which is coupled to the free end of the annular leg 32 so that the base is rotatable with respect to the annular leg 32. The base may be coupled to the annular leg 32 by snap-fastening. The separating element 5 has, outside of the interior of the container 2, two radial tabs 35, 36 facing away from each other. The free ends of the tabs 35, 36, have a respective cutout 37, 38 capable of engaging with a rib 39, 40 arranged axially on the inner surface of to the annular leg 32 over a substantial part of its height. This structure limits rotation of the separating element 5 during its axial movement, so that the separating element 5 moves axially upon rotation of the guiding stem 14. A seal 41 is preferably provided between a free edge 21 of an annular part 20 of the bottom of the wall 45 and the separating element 5, so as to improve the sealing of the interior of the container 2 at this point.

To perform mixing, a user grasps the rim 34 and rotates it with respect to the annular leg 32. The rim 34 serves as an actuator. As the actuator 34 is rotated, the interaction between the screw threads 30 and 31 causes the separating element 5 to be driven downwards until it lies essentially outside the container 2, in the position illustrated in FIG. 3C. As discussed with reference to the previous embodiment, the end wall 13 of the guiding stem 14 acts as a fixed piston so as to keep in the container 2 the product initially contained in the separating element 5. In the position shown in FIG. 3C, the open end 11 of the separating element 5 is approximately at the same level as the annular part 20, and as the end wall 13 of the guiding stem 14. As in the other embodiment, the mixture may be homogenized, once the lid 10 has been removed, using a spatula or a brush which is used to apply the mixture.

In both of the embodiments above, the guiding stem 14 acts as a piston for forcing the first product from the open end 11 of the separating element 5 to permit mixing of the first and second products in the interior of the container 2.

A method for combining at least two products is discussed below. Although the method is described with references to the structure disclosed in the figures, it should be understood that the method in its broadest sense is not so limited.

In the method according to the present invention, the separating element 5 is moved from the first position shown in FIGS. 2A and 3A to the second position shown in FIGS. 2B and 3C to place the regions 6,7 in fluid communication with one another and thereby permit mixing of the first and second products. Preferably, the separating element 5 moves from the first position to the second position without passing through the cover 10. After the separating element 5 is moved to the second position, the cover 10 is removed to access the first and second products via the opening 9.

In a further aspect, the method includes agitating the container 2 when the separating element 5 is in the second position to mix the first and second products. In yet a further aspect, the method includes stirring the first and second products after the separating element 5 moves to the second position.

The moving of the separating element 5 may further include passing the separating element 5 through the passage 22 at the bottom of the wall 45.

The method and device of the invention remove the separating element 5 at least substantially from the interior of the container 2. This allows the interior of the container 2 to be free of obstructions for easy removal of the mixture by an appropriate tool. This is especially helpful when dealing with a highly viscous material, because there is no internal structure on which the material will become adhered. By moving the separating element 5 from the first position to the second position without passing through the cover 10, the opening of the container 2 is not obstructed by the separating element 5.

It will be apparent to those skilled in the art that various modifications and variations can be made to the structure and methodology of the present invention without departing from the scope or spirit of the invention. In view of the foregoing, it is intended that the present invention cover modifications and variations of this invention provided they fall within the scope of the following claims and their equivalents.

What is claimed is:

1. A device for combining at least two products, the device comprising:

a container having at least one wall, the wall defining an interior of the container and an opening allowing access to the interior of the container; and a separating element movable with respect to the container from a first position, in which at least a portion of the separating element is in the interior of the container and defines in the interior of the container a first region for a first product and a second region for a second product, to a second position, in which the separating element is at least substantially removed from the interior of the container so that the regions are placed in fluid communication with one another to [permit] enable mixing of the first and second products, the separating element moving from the first position to the second position without passing through the opening, wherein the opening is configured to allow direct access to the first and second regions when the separating element is in the first position.

2. The device of claim 1, further comprising an actuator for causing movement of the separating element from the first position to the second position.

3. The device of claim 1, wherein the separating element is formed of at least one of a rigid and semi-rigid material.

4. The device of claim 1, wherein the separating element is configured so that it lacks deformation as it moves from the first position to the second position.

5. The device of claim 1, further comprising a removable cover for covering the opening.

6. The device of claim 5, wherein the separating element has an end forming a seal with the cover when the separating element is in the first position.

7. A device for combining at least two products, the device comprising:

a container having at least one wall, the wall defining an interior of the container and an opening allowing access to the interior of the container; and a separating element movable with respect to the container from a first position, in which at least a portion of the separating element is in the interior of the container and defines in the interior of the container a first region for a first product and a second region for a second product, to a second position, in which the separating element is at least substantially removed from the interior of the container so that the regions are placed in fluid communication with one another to enable mixing of the first and second products, the separating element moving from the first position to the second position without passing through the opening wherein the separating element has a hollow interior, the hollow interior defining the second region when the separating element is in the first position.

8. The device of claim 7, wherein the device further comprises a guiding stem axially fixed with respect to the wall of the container, the guiding stem being positioned in the hollow interior of the separating element when the separating element moves from the first position to the second position.

9. The device of claim 8, further comprising a passage in the wall of the container, the separating element passing through the passage during movement of the separating element from the first position to the second position, wherein the passage is sized to limit flow of the first and second products through the passage when the separating element moves from the first position to the second position.

10. The device of claim 9, wherein the separating element and the guiding stem each have a cylindrical shape, and wherein the passage is an annular space defined between the guiding stem and the wall.

11. The device of claim 10, wherein the separating element has an outer surface including a helical screw thread, the helical screw thread engaging a portion of the wall defining the passage, the separating element being rotatable with respect to the wall to cause movement of the separating element from the first position to the second position.

12. The device of claim 10, further comprising an actuating collar on the separating element.

13. The device of claim 12, wherein the container includes at least two peripheral legs extending from the wall of the container, the actuating collar being between the legs, the legs being configured to permit access to the actuating collar.

14. The device of claim 13, wherein the guiding stem has a base coupled to the container.

15. The device of claim 14, wherein the base is coupled to the legs by one of bonding, welding and fastening.

16. The device of claim 10, further comprising a helical screw thread provided on an outer surface of the guiding stem and a corresponding inner screw thread provided on an inner surface of the separating element, the guiding stem being rotatable with respect to the separating element to cause movement of the separating element from the first position to the second position.

17. The device of claim 16, further comprising an rotatable actuator on the guiding stem, rotation of the actuator causing the separating element to pass from the first position to the second position.

18. The device of claim 16, further comprising a rotation limiter for limiting rotation of the separating element.

19. The device of claim 16, wherein the container includes an annular leg surrounding the guiding stem, the annular leg extending from the wall of the container.

20. The device of claim 19, wherein the guiding stem includes a base coupled to the annular leg so that the base is rotatable with respect to the annular leg.

21. The device of claim 20, wherein the base is coupled to the annular leg by snap-fastening.

22. A device for combining at least two products, the device comprising:

a container having at least one wall, the wall defining an interior of the container and an opening allowing access to the interior of the container; and a separating element movable with respect to the container from a first position, in which at least a portion of the separating element is in the interior of the container and defines in the interior of the container a first region for a first product and a second region for a second product, to a second position, in which the separating element is at least substantially removed from the interior of the container so that the regions are placed in fluid communication with one another to permit mixing of the first and second products, the separating element moving from the first position to the second position without passing through the opening, wherein the wall of the container is in the shape of a bowl.

23. A device for combining at least two products, the device comprising:

a container having at least one wall, the wall defining an interior of the container and an opening allowing access to the interior of the container; and a separating element movable with respect to the container from a first position, in which at least a portion of the separating element is in the interior of the container and defines in the interior of the container a first region for a first product and a second region for a second product, to a second position, in which the separating element is at least substantially removed from the interior of the container so that the regions are placed in fluid communication with one another to enable mixing of the first and second products, the separating element moving from the first position to the second position without passing through the opening wherein the first region contains a first product and the second region contains a second product, at least one of the first and second products including a liquid.

24. The device of claim 23, wherein the first product comprises a liquid oxidizing agent and the second product comprises at least one of a viscous and pulverulent dye, and wherein a mixture of the first product and second product forms a hair composition.

25. The device of claim 23, wherein the separating element is configured so that at least a portion of at least one of the first and second products rotates as the separating element moves from the first position to the second position.

26. A device for combining at least two products, the device comprising:

a container having at least one wall, the wall defining an interior of the container, an opening for allowing access to the interior of the container, and a passage; and a separating element movable with respect to the container from a first position, in which at least a portion of the separating element is in the interior of the container and defines in the interior of the container a first region for a first product and a second region for a second product, to a second position, in which the separating element is at least substantially removed from the interior of the container so that the regions are placed in fluid communication with one another to enable mixing of the first and second products, the separating element passing through the passage during movement of the separating element from the first position to the second position, wherein the first region substantially surrounds the second region when the separating element is in the first position.

27. The device of claim 26, further comprising a removable cover for covering the opening.

28. The device of claim 26, wherein the separating element is formed of at least one of a rigid material and a semi-rigid material.

29. A method for combining at least two products in a device including a container having at least one wall defining an interior of the container and an opening for allowing access to the interior of the container, the device further including a removable cover for covering the opening, and a separating element moveable with respect to the container from a first position, in which at least a portion of the separating element is in the interior of the container and defines in the interior of the container a first region containing a first product and a second region containing a second product, to a second position in which the separating element is at least substantially removed from the interior of the container, the method comprising:

moving the separating element from the first position to the second position to place the regions in fluid communication with one another and thereby enable mixing of the first and second products, the separating element moving from the first position to the second position without passing through the cover;

mixing the first and second products; and removing the cover to access the first and second products via the opening.

30. The method of claim 29, further comprising agitating the container when the separating element is in the second position to mix the first and second products.

31. The method of claim 29, further comprising stirring the first and second products after the separating element moves to the second position.

32. The method of claim 29, wherein the moving of the separating element further includes passing the separating element through a passage in the wall.

33. The method of claim 32, wherein the moving of the separating element further includes rotating an actuator to move the separating element.

34. The method of claim 33, wherein the moving of the separating element further includes moving the separating element via a helical thread.

35. A device for combining at least a first product and a second product, comprising:

a container having at least one wall, the wall defining an interior of the container for containing the first and second products, and an opening for allowing access to the interior of the container;

a separating element in the interior of the container, the separating element having an open end in fluid communication with a hollow interior of the separating element, the separating element being movable from a first position, in which the first product is contained in a region between the separating element and the wall of the container and the second product is contained in the hollow interior of the separating element, to a second position; and a piston in the hollow interior of the separating element, the piston being axially fixed with respect to the container so that when the separating element moves relative to the piston from the first position to the second position the piston forces the first product from the open end of the separating element to permit mixing of the first and second products in the interior of the container.

36. The device of claim 35, further comprising a removable covering for covering the opening.

37. The device of claim 36, wherein the open end of the separating element forms a seal with the cover when the separating element is in the first position.

38. The device of claim 37, wherein the separating element is configured so that the separating element is at least substantially removed from the interior of the container when the separating element is in the second position.

39. The device of claim 35, wherein the separating element and the piston each have a cylindrical shape.

40. A device for combining at least two products, the device comprising:

a container having at least one wall, the wall defining an interior of the container and an opening allowing access to the interior of the container; and a separating element movable with respect to the container from a first position, in which at least a portion of the separating element is in the interior of the container and defines in the interior of the container a first region for a first product and a second region for a second product, to a second position, in which the separating element is at least substantially removed from the interior of the container so that the regions are placed in fluid communication with one another to enable mixing of the first and second products, the separating element moving from the first position to the second position in a direction facing away from the opening, without passing through the opening.

41. A device for combining at least two products, the device comprising:

a container having at least one wall, the wall defining an interior of the container and an opening allowing access to the interior of the container; and a separating element movable with respect to the container from a first position, in which at least a portion of the separating element is in the interior of the container and defines in the interior of the container a first region for a first product and a second region for a second product, to a second position, in which the separating element is at least substantially removed from the interior of the container so that the regions are placed in fluid communication with one another to enable mixing of the first and second products, the first region substantially surrounding the second region when the separating element is in the first position, wherein the separating element moves from the first position to the second position without passing through the opening.

42. A device for combining at least two products, the device comprising:

a container having at least one wall, the wall defining an interior of the container and an opening allowing access to the interior of the container; and a separating element movable with respect to the container from a first position, in which at least a portion of the separating element is in the interior of the container and defines in the interior of the container a first region for a first product and a second region for a second product, to a second position, in which the separating element is at least substantially removed from the interior of the container so that the regions are placed in fluid communication with one another to enable mixing of the first and second products, the separating element moving from the first position to the second position without passing through the opening, wherein an upper portion of one of the first and second regions is located above a lower portion of the other of the first and second regions when the separating element is in the first position.

43. A device for combining at least two products, the device comprising:

a container having at least one wall, the wall defining an interior of the container, an opening for allowing access to the interior of the container, and a passage; and a separating element movable with respect to the container from a first position, in which at least a portion of the separating element is in the interior of the container and defines in the interior of the container a first region for a first product and a second region for a second product, to a second position, in which the separating element is at least substantially removed from the interior of the container so that the regions are placed in fluid communication with one another to enable mixing of the first and second products, the separating element passing through the passage and in a direction facing away from the opening during movement of the separating element from the first position to the second position.

44. A device for combining at least two products, the device comprising:

a container having at least one wall, the wall defining an interior of the container, an opening for allowing access to the interior of the container, and a passage; and a separating element movable with respect to the container from a first position, in which at least a portion of the separating element is in the interior of the container and defines in the interior of the container a first region for a first product and a second region for a second product, to a second position, in which the separating element is at least substantially removed from the interior of the container so that the regions are placed in fluid communication with one another to enable mixing of the first and second products, the separating element passing through the passage during movement of the separating element from the first position to the second position, wherein the separating element has a hollow interior, the hollow interior defining the second region when the separating element is in the first position.

45. A device for combining at least two products, the device comprising:

a container having at least one wall, the wall defining an interior of the container, an opening for allowing access to the interior of the container, and a passage; and a separating element movable with respect to the container from a first position, in which at least a portion of the separating element is in the interior of the container and defines in the interior of the container a first region for a first product and a second region for a second product, to a second position, in which the separating element is at least substantially removed from the interior of the container so that the regions are placed in fluid communication with one another to enable mixing of the first and second products, the separating element passing through the passage during movement of the separating element from the first position to the second position, wherein the opening is configured to allow direct access to the first and second regions when the separating element is in the first position.

46. A device for combining at least two products, the device comprising:

a container having at least one wall in the shape of a bowl, the wall defining an interior of the container, an opening for allowing access to the interior of the container, and a passage; and a separating element movable with respect to the container from a first position, in which at least a portion of the separating element is in the interior of the container and defines in the interior of the container a first region for a first product and a second region for a second product, to a second position, in which the separating element is at least substantially removed from the interior of the container so that the regions are placed in fluid communication with one another to enable mixing of the first and second products, the separating element passing through the passage during movement of the separating element from the first position to the second position.

47. A device for combining at least two products, the device comprising:

a container having at least one wall, the wall defining an interior of the container, an opening for allowing access to the interior of the container, and a passage; and a separating element movable with respect to the container from a first position, in which at least a portion of the separating element is in the interior of the container and defines in the interior of the container a first region for a first product and a second region for a second product, to a second position, in which the separating element is at least substantially removed from the interior of the container so that the regions are placed in fluid communication with one another to enable mixing of the first and second products, the separating element passing through the passage during movement of the separating element from the first position to the second position, wherein the first region contains a first product and the second region contains a second product, at least one of the first and second products including a liquid.

48. The device of claim 47, wherein the separating element is configured so that at least a portion of at least one of the first and second products rotates as the separating element moves from the first position to the second position.

49. A device for combining at least two products, the device comprising:

a container having at least one wall, the wall defining an interior of the container, an opening for allowing access to the interior of the container, and a passage; and a separating element movable with respect to the container from a first position, in which at least a portion of the separating element is in the interior of the container and defines in the interior of the container a first region for a first product and a second region for a second product, to a second position, in which the separating element is at least substantially removed from the interior of the container so that the regions are placed in fluid communication with one another to enable mixing of the first and second products, the separating element passing through the passage during movement of the separating element from the first position to the second position, wherein an upper portion of one of the first and second regions is located above a lower portion of the other of the first and second regions when the separating element is in the first position.

50. A device for combining at least two products, the device comprising:

a container having at least one wall, the wall defining an interior of the container and an opening allowing access to the interior of the container; and a separating element movable with respect to the container from a first position, in which at least a portion of the separating element is in the interior of the container and defines in the interior of the container a first region for a first product and a second region for a second product, to a second position, in which the separating element is at least substantially removed from the interior of the container so that the regions are placed in fluid communication with one another to enable mixing of the first and second products, the separating element moving from the first position to the second position without passing through the opening, wherein the first region contains a first product and the second region contains a second product, and wherein the device is configured so that upon mixing of the first and second products, the first and second products are brought into contact with one another without any translational movement of one product with respect to the other product.

* * * * *

UNITED STATES PATENT AND TRADEMARK OFFICE

CERTIFICATE OF CORRECTION

PATENT NO.: 6,148,995

DATED: November 21, 2000

INVENTOR: Vincent de Laforcade

It is certified that errors appear in the above-identified patent and that said Letters Patent is hereby corrected as shown below:

On the Title Page, Item [75], line 1, change "De Laforcade" to --de Laforcade--;

claim 1, col. 10, line 50, delete "[permit]" ;

claim 7, col. 11, line 17, after "opening" insert --,--;

claim 17, col. 11, line 61, change "an" to --a--;

claim 23, col. 12, line 41, after "opening" insert --,--; and claim 29, col. 13, line 18, change "moveable" to --movable--.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*